US005209348A

United States Patent [19]

Schafer, III

[11] Patent Number: 5,209,348

[45] Date of Patent: May 11, 1993

[54] CEREAL BOWL WITH SEPARATE SELF-CONTAINED CEREAL AND MILK COMPARTMENTS

[75] Inventor: Vernon Schafer, III, Newport Beach, Calif.

[73] Assignee: James D. Schafer, Newport Beach, Calif. ; a part interest

[21] Appl. No.: 893,535

[22] Filed: Jun. 4, 1992

[51] Int. Cl.[5] ..... B61D 25/08

[52] U.S. Cl. ..... 206/222; 220/23.83; 220/506; 220/575; 426/120

[58] Field of Search ..... 206/222, 219; 220/23.83, 28.86, 575, 506; 426/120, 119

[56] References Cited

U.S. PATENT DOCUMENTS

| | | | |
|---|---|---|---|
| 3,756,571 | 9/1973 | Winberg | 206/222 |
| 4,174,035 | 11/1979 | Wiegner | 206/222 |
| 4,177,938 | 12/1979 | Brina | 206/222 |
| 4,253,773 | 3/1981 | Aho et al. | 206/222 |
| 4,793,323 | 12/1988 | Guida et al. | 206/222 |
| 4,844,251 | 7/1989 | Gueret . | |

*Primary Examiner*—Joseph Man-Fu Moy
*Attorney, Agent, or Firm*—Roberts and Quiogue

[57] ABSTRACT

A cereal bowl having separate cereal and milk compartments, with a valve permitting emptying the contents of the milk container into the cereal container. Separate lids are provided for the milk and cereal compartments. The cereal bowl enables young children to serve their own breakfast meals without spilling milk and cereal.

10 Claims, 2 Drawing Sheets

CEREAL BOWL WITH SEPARATE SELF-CONTAINED CEREAL AND MILK COMPARTMENTS

BACKGROUND OF THE INVENTION

The present invention relates to cereal bowls for young children, and more particularly to a cereal bowl having a self-contained milk compartment separate from the cereal container, permitting the saving of time and needless spills of cereal and milk caused by young children getting their own meals.

A popular breakfast food for young and old alike is that of dry cereal with milk. This food is prepared by putting the dry cereal into a cereal bowl, and then adding milk to the cereal at the time of breakfast.

This method of preparing cereal leads to spilled cereal and milk when small children attempt to prepare their own breakfasts, particularly when unattended, as when the early-rising child's parents are asleep. If the breakfast could be prepared the night before, for example, the child could take an early breakfast without disturbing his or her parents. Of course, the milk cannot be added to the dry cereal the night before breakfast, as the cereal would become soggy.

It is therefore an object of the present invention to provide a cereal bowl with a self-contained milk container to allow the breakfast meal to be prepared well in advance of the breakfast, and which is simple enough to operate to permit young children to operate the same to dispense the milk into the cereal bowl at the appropriate time.

SUMMARY OF THE INVENTION

A self-contained cereal and milk bowl is described, comprising a cereal container suitable for holding a quantity of cereal, and a milk container separate from the cereal container. The milk container is suitable for holding a quantity of milk sufficient to mix with the cereal in the cereal container. The bowl further comprises valve means for selectively emptying the milk into the cereal container from the milk container.

In a preferred embodiment, the cereal container comprises a bowl defined by a bottom surface member and an inner sidewall member, and the milk container comprises an annular container member disposed about the periphery of the inner sidewall member.

Preferably, the valve comprises a valve member fitted in the inner sidewall between the milk container and the milk container, and an actuating rod extending between the inner sidewall member and an outer sidewall member defining an outer wall of the milk container, whereby pushing the rod actuates the valve member to release milk into the cereal container.

The cereal and milk bowl further comprises a cereal container lid for fitting over the top of the cereal container, and a milk container lid for fitting over the top of the milk container.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
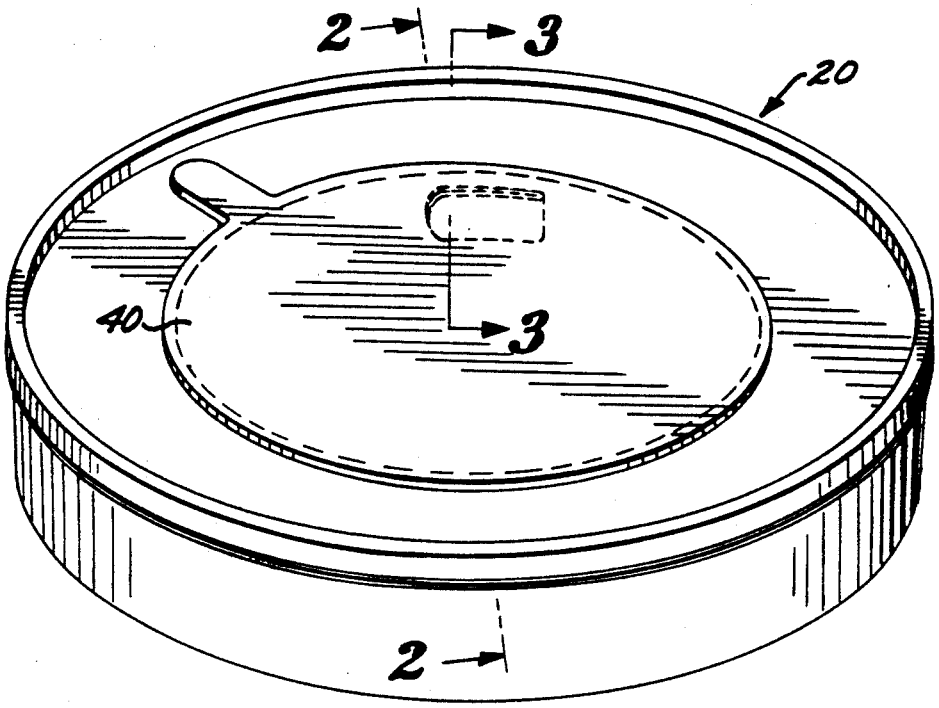
FIG. 1 is a perspective view of a cereal bowl having a self-contained milk compartment in accordance with the invention.
Figure 2:
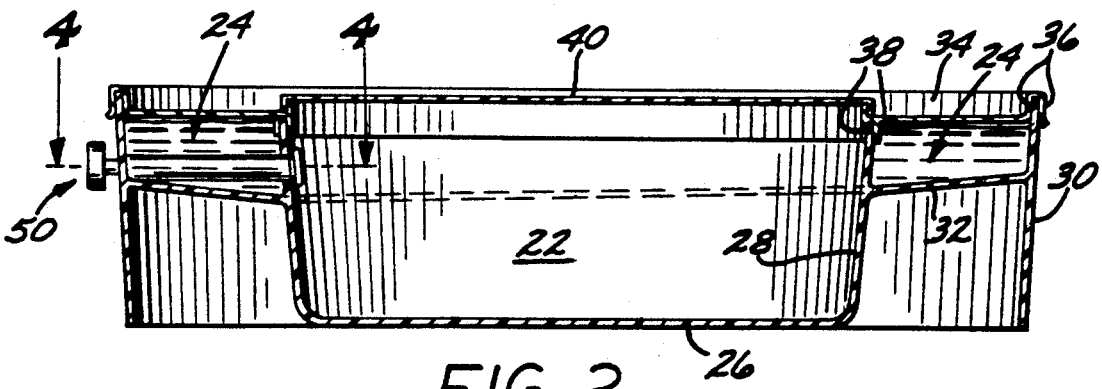
FIG. 2 is a side cross-sectional view of the cereal bowl of FIG. 1 taken along line 2—2 of FIG. 1.
Figure 3:
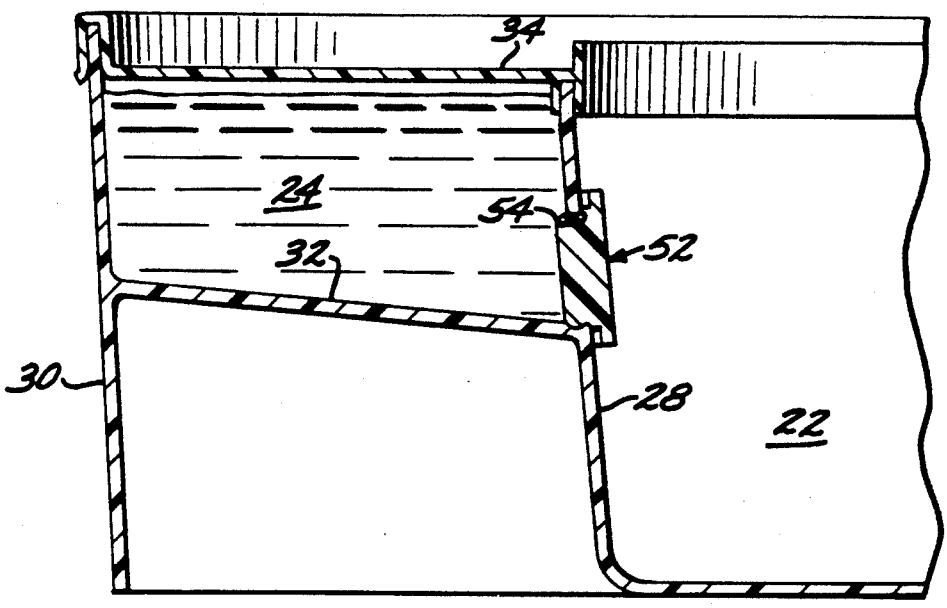
FIG. 3 is a side partial cross-sectional view of the cereal bowl of FIG. 1 taken along line 3—3.
Figure 4:
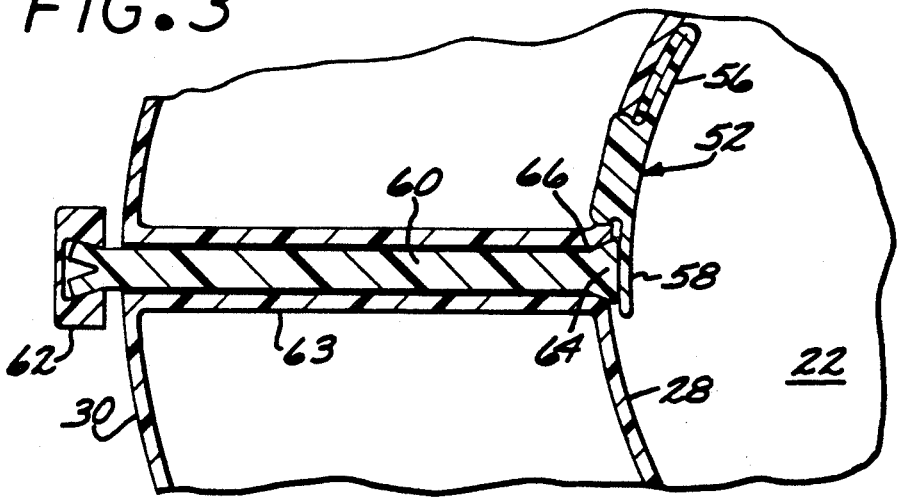
FIG. 4 is a partial cross-sectional view taken along line 4—4 of FIG. 2.

FIGS. 1-4 illustrate a cereal bowl 20 embodying the present invention. The bowl 20 comprises a cereal compartment 22 having a generally circular configuration as viewed from the top of the bowl, and defined by a bottom member 26 and an upstanding circumferential interior sidewall 28. The bowl 20 further comprises an outer circumferential sidewall 30 spaced from the interior sidewall 28, and a connecting annular surface 32 extending between the sidewalls 28 and 30, and having a slight downwardly inclination from the outer to the inner sidewall.

The inner and outer sidewalls 28 and 30 together with the surface 32 define a container 24 for milk which is separate from the cereal container 22. A milk container lid 34 shaped generally in the shape of a flat ring with sealing flanges defined at each edge thereof can be disposed over the container 24 after pouring milk into the container 24. Typically the lid 34 includes downwardly extending flanges 36 and 38 to engage the upwardly extending edges of the sidewalls 28 and 30 to seal the lid to the sidewalls and prevent leakage of milk from the container 24.

The bowl 20 further comprises a cereal container lid 40 which is press-fit into the circular opening defined by the lid 34. Thus, the bowl includes a milk container lid 34 for preventing the spillage of milk from the container 24, and a cereal container lid 40 for preventing the spillage of cereal from the container 22. The containers 22 and 24 can be filled with quantities of cereal and milk respectively, and then sealed by the lids 34 and 40 to prevent spills as the bowl 20 is subsequently handled. Moreover, the milk and cereal are separated from each other. Thus, the bowl 20 could be refrigerated for a time, typically overnight, without the cereal from becoming soggy due to immersion in milk.

Figure 5:
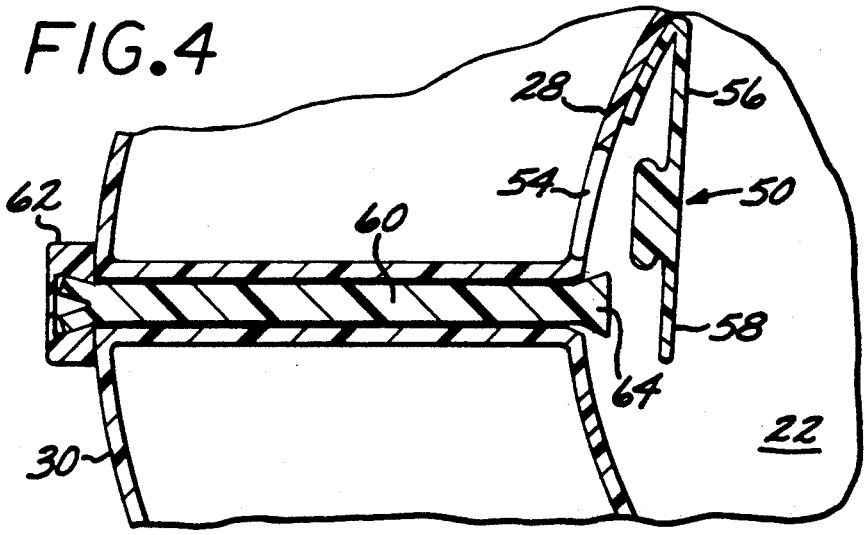
FIG. 5 is a partial cross-sectional view similar to FIG. 4 except that the valve connecting the milk container to the cereal container is shown in the opened condition.

The bowl 20 further comprises a valve 50 for selectively emptying the contents of the milk container 24 into the cereal container 22. The construction and operation of the valve 50 is shown more clearly in FIGS. 3-5. The valve 50 comprises an elastomeric plug 52 fitted into a circular hole 54 formed in the interior sidewall 28. A tab of elastomeric material 56 forms a hinge connecting one side of the plug 52 to the sidewall 28. A tab 58 extends from the other side of the plug 52.

The valve 50 further comprises a rod 60 which extends through a tube 63 fitted between the inner and outer sidewall members 28 and 30. The rod 60 is pressed by the bowl user to bear against the tab 58 and push the plug 52 out of the opening 54, thereby releasing the milk from the container 24 to flow into the cereal container 22. A button-like member 62 is fitted over the outer, exposed end of the rod 60. The interior end 64 of the rod 60 is tapered outwardly and is fitted through an opening 66 formed in the sidewall 28. Thus, when the plug 52 is fitted tightly into the opening 54, the tab 58 fits against the end of the rod 60, and the rod can be pressed into tight engagement with the opening 66. The ends of the tuber 65 are respectively sealed to the outer and inner sidewalls 30 and 28 to prevent milk from leaking around the rod 60.

To release milk into the cereal container 22, the button 62 of the rod 60 is pressed against the sidewall 30, thereby pushing the tab 58 inwardly and forcing the plug 52 out of the hole 54. Milk is then released into the cereal container 22, and with the cereal lid 40 removed, the cereal with milk can be eaten. Moreover, the lowest surface of the milk container in this embodiment is disposed above the lower surface 26 of the cereal container, so that the entire contents of the milk container 24 can be emptied into the cereal container.

The cereal bowl can be formed from injection-molded elements of an elastomeric material commonly used to form sealable kitchen food containers. Thus, the cereal bowl 20 is amenable to low-cost production in quantity.

It is understood that the above-described embodiments are merely illustrative of the possible specific embodiments which may represent principles of the present invention. For example, the rod 60 could be disposed just beneath the surface 32, with the tab 58 disposed downwardly over the rod end. The tube 63 would not be necessary in this alternate embodiment, since the rod would not extend through the milk container 24. Other arrangements may readily be devised in accordance with these principles by those skilled in the art without departing from the scope and spirit of the invention.

What is claimed is:

1. A reusable self-contained cereal and milk bowl, comprising:

a bottom member on which the bowl rests;

a cereal container suitable for holding a quantity of cereal;

a milk container separate from said cereal container and suitable for holding a quantity of milk sufficient to mix with said cereal in said cereal container, said cereal container and said milk container sharing an inner sidewall member, said compartment comprising an opening permitting milk to be poured into said container when said bottom member is resting on a flat surface; and reusable valve means for selectively emptying said milk into said cereal container from said milk container, said valve comprising a valve member fitted in an opening in said inner sidewall for selectively permitting milk to flow from said milk container into said cereal container, wherein said valve member may be removed from said opening to permit said milk flow, and replaced within said opening to prevent said milk flow.

2. The cereal and milk bowl of claim 1 wherein said cereal container comprises a bowl defined by a bottom surface member and said inner sidewall member, and wherein said milk container comprises an annular container member disposed about the periphery of said sidewall member.

3. A self-contained cereal and milk bowl, comprising:

a cereal container suitable for holding a quantity of cereal, said container comprising a bowl defined by a bottom surface member and an inner sidewall member;

a milk container separate from said cereal container and suitable for holding a quantity of milk sufficient to mix with said cereal in said cereal container, said milk container comprising an annular container member disposed about the periphery of said sidewall member; and valve means for selectively emptying said milk into said cereal container from said milk container, said valve means comprising a valve member fitted in said inner sidewall between said cereal container and said milk container.

4. The cereal and milk bowl of claim 3 wherein said valve further comprises an actuating rod extending between said inner sidewall member and an outer sidewall member defining an outer wall of said milk container, whereby pushing said rod actuates said valve member to release milk into said cereal container.

5. The cereal and milk bowl of claim 4 wherein said valve member comprises a plug member fitted into a valve opening formed in said inner sidewall, and further comprising hinge means connecting one portion of said plug member to said sidewall.

6. The cereal and milk bowl of claim 5 wherein said valve member further comprises a tab extending from said a portion of said plug, and wherein said rod engages against said tab to push said plug out of said valve opening to release the milk from the milk container into said cereal container.

7. The cereal and milk bowl of claim 4 wherein said valve further comprises a tube extending between said inner sidewall and said outer sidewall, and wherein said rod extends through said tube.

8. The cereal and milk bowl of claim 3 further comprising a cereal container lid for fitting over the top of said cereal container.

9. The cereal and milk bowl of claim 3 further comprising a milk container lid for fitting over the top of said milk container.

10. A self-contained cereal and milk bowl, comprising:

a cereal container suitable for holding a quantity of cereal, said cereal container comprising a bowl defined by a bottom surface member and an inner sidewall member;

a milk container separate from said cereal container and suitable for holding a quantity of milk sufficient to mix with said cereal in said cereal container;

valve means for selectively emptying said milk into said cereal container from said milk container; and wherein said milk container further comprises an inclined floor member extending between said inner sidewall member and an outer sidewall member defining an outer wall of said milk container, said floor member inclined downwardly from said outer sidewall to said inner sidewall, said floor member being elevated above the lower portion of the cereal container.

* * * * *